US008922107B2

(12) United States Patent
Rao et al.

(10) Patent No.: US 8,922,107 B2
(45) Date of Patent: Dec. 30, 2014

(54) VACUUM ENCAPSULATED HERMETICALLY SEALED DIAMOND AMPLIFIED CATHODE CAPSULE AND METHOD FOR MAKING SAME

(75) Inventors: Triveni Rao, Shoreham, NY (US); John Walsh, Sound Beach, NY (US); Elizabeth Gangone, New Hyde Park, NY (US)

(73) Assignee: Brookhaven Science Associates, LLC, Upton, NY (US)

( * ) Notice: Subject to any disclaimer, the term of this patent is extended or adjusted under 35 U.S.C. 154(b) by 0 days.

(21) Appl. No.: 14/115,534

(22) PCT Filed: May 9, 2012

(86) PCT No.: PCT/US2012/037095

§ 371 (c)(1), (2), (4) Date: Jan. 9, 2014

(87) PCT Pub. No.: WO2012/154833

PCT Pub. Date: Nov. 15, 2012

(65) Prior Publication Data

US 2014/0117837 A1 May 1, 2014

Related U.S. Application Data

(60) Provisional application No. 61/484,433, filed on May 10, 2011.

(51) Int. Cl.

| | |
|---|---|
| ***H01J 1/32*** | (2006.01) |
| ***H01J 29/41*** | (2006.01) |
| ***H01J 9/12*** | (2006.01) |
| ***H01J 1/35*** | (2006.01) |
| ***H01J 29/04*** | (2006.01) |
| ***H01J 3/02*** | (2006.01) |
| ***H01J 25/10*** | (2006.01) |
| ***H01J 23/04*** | (2006.01) |
| ***H01J 9/18*** | (2006.01) |

(52) U.S. Cl.

CPC ..... *H01J 29/04* (2013.01); *H01J 3/021* (2013.01); *H01J 25/10* (2013.01); *H01J 23/04* (2013.01); *H01J 9/125* (2013.01); *H01J 9/18* (2013.01)

USPC ..... 313/399; 313/387; 445/44; 445/51; 445/59

(58) Field of Classification Search

USPC ..... 313/379, 377, 399–401; 445/23, 44, 51, 445/59

See application file for complete search history.

(56) References Cited

U.S. PATENT DOCUMENTS 5,473,218 A 12/1995 Moyer
5,986,387 A * 11/1999 Niigaki et al. ..... 313/103 R (Continued)

FOREIGN PATENT DOCUMENTS

JP 10223162 A * 8/1998

*Primary Examiner* — Mariceli Santiago
(74) *Attorney, Agent, or Firm* — Dorene M. Price

(57) ABSTRACT

A vacuum encapsulated, hermetically sealed cathode capsule for generating an electron beam of secondary electrons, which generally includes a cathode element having a primary emission surface adapted to emit primary electrons, an annular insulating spacer, a diamond window element comprising a diamond material and having a secondary emission surface adapted to emit secondary electrons in response to primary electrons impinging on the diamond window element, a first cold-weld ring disposed between the cathode element and the annular insulating spacer and a second cold-weld ring disposed between the annular insulating spacer and the diamond window element. The cathode capsule is formed by a vacuum cold-weld process such that the first cold-weld ring forms a hermetical seal between the cathode element and the annular insulating spacer and the second cold-weld ring forms a hermetical seal between the annular spacer and the diamond window element whereby a vacuum encapsulated chamber is formed within the capsule.

22 Claims, 7 Drawing Sheets

(56) References Cited

U.S. PATENT DOCUMENTS

| | | | | |
|---|---|---|---|---|
| 6,060,839 | A | 5/2000 | Sverdrup, Jr. et al. | |
| 6,323,594 | B1 | 11/2001 | Janning | |
| 7,005,795 | B2 * | 2/2006 | Pickard et al. | 313/495 |
| 2004/0075379 | A1 * | 4/2004 | Jin | 313/495 |
| 2007/0029935 | A1 * | 2/2007 | Sakai et al. | 313/609 |
| 2013/0320295 | A1 * | 12/2013 | Rao et al. | 257/11 |

* cited by examiner

VACUUM ENCAPSULATED HERMETICALLY SEALED DIAMOND AMPLIFIED CATHODE CAPSULE AND METHOD FOR MAKING SAME

CROSS-REFERENCE TO RELATED APPLICATIONS

This application is a National Phase application of International Application No. PCT/US 2012/037095 filed May 9, 2012, which claims the benefit of U.S. Provisional Application No. 61/484,433, filed on May 10, 2011, which are incorporated herein by reference in their entirety for all purposes.

STATEMENT OF GOVERNMENT LICENSE RIGHTS

This invention was made with Government support under contract number DE-AC02-98CH10886, awarded by the U.S. Department of Energy. The Government has certain rights in the invention.

FIELD OF THE INVENTION

The present electron generating cathode is generally for use in an electron gun and relates more particularly to a vacuum encapsulated, hermetically sealed diamond amplified cathode capsule and an efficient, non-contaminating method for making same.

BACKGROUND

Electron guns are used to generate a directed stream of electrons with a predetermined kinetic energy. Electron guns are most commonly used to generate electron beams for vacuum tube applications such as cathode ray tubes (CRTs) found in televisions, game monitors, computer monitors and other types of displays.

Many medical and scientific applications require the generation of electron beams as well. Electron guns provide the electron source for the generation of X-rays for both medical and scientific research applications, provide the electron beam for imaging in scanning electron microscopes, and are used for microwave generation, e.g., in klystrons.

In many cases, the electron gun is incorporated into a linear accelerator system, or LINAC. LINACs have many industrial applications, including radiation therapy, medical and food product sterilization by irradiation, polymer cross linking and nondestructive testing (NDT) and inspection.

In addition, an electron gun is a key component of the injector system of many high-energy particle accelerator systems. The creation of high average-current, high brightness electron beams is a key enabling technology for these accelerator-based systems, which include high-energy LINACs such as Energy-Recovery LINAC (ERL) light sources, electron cooling of hadron accelerators, high-energy ion colliders, and high-power free-electron lasers (FELs). For these applications, the electron gun generates and provides a charged particle beam for input to the accelerator. The output of the accelerator system is an accelerated beam at the energy required for the particular application.

An electron gun, also referred to as an injector, is composed of at least two basic elements: an emission source and an accelerating region. The emission source includes a cathode, from which the electrons generated in the emission source escape. The accelerating region accelerates the electrons in the presence of an electric field to an accelerating electrode (anode), typically having an annular shape, through which the electrons pass with a specific kinetic energy. The commonly known cathodes used in electron guns generate electrons either by thermionic emission, field emission, or photoemission.

Photoemission cathodes typically generate a large number of electrons by photoemission from a laser-illuminated photocathode. The accelerated electrons typically enter an accelerating structure to reach higher energy. A high-current electron beam is thus generated at an output port of the injector of a high-power accelerator.

Very high average current electron injectors are required for a number of applications. The amplitude of the current is determined by the quantum efficiency (QE) of the cathode and the power of the laser beam available. Hence, the obvious choice for these applications is a high QE cathode irradiated by the highest power of the laser available. However, there are inherent problems with this approach. The high QE cathodes are typically sensitive to contamination and thus have a very limited lifetime. Furthermore, the commercially available lasers do not have enough power to deliver the average currents required from these cathodes for some of these applications.

A reliable, efficient, long-life high power laser and photocathode combination capable of generating high-current low-emittance electron beams has recently been disclosed in commonly owned U.S. Pat. Nos. 7,227,297 and 7,601,042 to Srinivasan-Rao et al., ("the Srinivasan-Rao patents"), the specifications of which are incorporated herein by reference in their entireties for all purposes. The electron gun device disclosed in these patents includes a secondary emitter that emits secondary electrons in response to receiving a beam of primary electrons. In one mode, the primary beam of electrons is generated by photoemission from the photocathode in response to a laser beam striking the photocathode.

In a preferred embodiment, the Srinivasan-Rao patents propose using an encapsulated secondary emission enhanced cathode device, which contains the photocathode and the secondary emitter in a vacuum within a housing. The photocathode includes a primary emission surface adapted to emit primary electrons from the primary emission surface. The housing defines a drift region through which the primary electrons are accelerated to a desired energy. The secondary emitter has a secondary emission surface that has negative-electron-affinity. The secondary emission surface emits secondary electrons in response to primary electrons impinging on the secondary emitter.

The Srinivasan-Rao patents further disclose use of one of single crystal diamond, polycrystalline diamond, and diamond-like carbon for the non-contaminating secondary emitter. It has been found that such a diamond amplified photocathode can perform multiple functions: 1) It amplifies the primary current from a conventional photocathode with amplification factors exceeding 200, thereby reducing the demands on the primary cathode and the laser; and 2) It also acts as a window that isolates the cathode from the RF cavity, thereby shielding them from contaminating each other.

However, while the general concept of an encapsulated secondary emission enhanced cathode device has been proposed, attempts to successfully commercially fabricate such devices have proven quite difficult and a specific optimum structure for such a device has heretofore been unknown. For example, earlier attempts at forming such encapsulated composite structures involved brazing techniques. However, brazing diamond to other materials such as niobium (Nb) was met with limited success. Specifically, the high temperatures required in brazing were incompatible with the diamond preparation and $K_2CsSb$ cathode fabrication.

Accordingly, it would be desirable to provide an encapsulated secondary emission enhanced cathode device for use in an electron gun, which is easily and reliably manufactured. It would be further desirable to provide such a cathode device having an optimum non-contaminating structure, which permits simple and reliable manufacture and which will efficiently operate in superconducting RF electron guns for the generation of high-current high-brightness electron beams.

SUMMARY

A vacuum encapsulated, hermetically sealed cathode capsule for generating an electron beam of secondary electrons is described. The capsule generally includes a cathode element having a primary emission surface adapted to emit primary electrons, an annular insulating spacer, a diamond window element comprising a diamond material and having a secondary emission surface adapted to emit secondary electrons in response to primary electrons impinging on the diamond window element, a first cold-weld ring disposed between the photocathode element and the annular insulating spacer and a second cold-weld ring disposed between the annular insulating spacer and the diamond window element. The present cathode capsule is formed by a vacuum cold-weld process such that the first cold-weld ring forms a hermetical seal between the cathode element and the annular insulating spacer and the second cold-weld ring forms a hermetical seal between the annular spacer and the diamond window element whereby a vacuum encapsulated chamber is formed within the capsule.

In a preferred embodiment, the first and second cold-weld rings are made with a material selected from the group consisting of indium, lead and tin. Also, the cathode element, the diamond window element and the annular insulating spacer preferably have interface surfaces coated with a metallic wetting material, wherein the metallic wetting material is in contact with one of the first and second cold-weld rings to promote atomic adhesion therebetween. With indium cold-weld rings, use of a nickel wetting material is preferred.

In one embodiment, the cathode element may be formed from a copper base and the wetting material may take the form of a nickel material vacuum sputtered on an outer peripheral rim of the copper base. In an alternative embodiment, the cathode element may take the form of a nickel base with a photo-sensitive oxygen-free copper material layer disposed in the center of a major surface of the nickel base. In this case, the copper layer forms a primary photocathode emission surface.

A method for fabricating a diamond amplified cathode capsule for generating an electron beam of secondary electrons is also described. The present method generally includes the steps of providing a cathode element having a primary emission surface adapted to emit primary electrons, providing an annular insulating spacer, providing a diamond window element comprising a diamond material and having a secondary emission surface adapted to emit secondary electrons in response to primary electrons impinging on the diamond window element, stacking a first cold-weld ring between the cathode element and the annular insulating spacer, stacking a second cold-weld ring between the annular insulating spacer and the diamond window element and cold-welding the cathode element, the annular insulating spacer, the diamond window element and the first and second cold-weld rings under vacuum. The cold-weld process is performed in a manner such that the first cold-weld ring forms a hermetical seal between the cathode element and the annular insulating spacer and the second cold-weld rings form a hermetical seal between the annular spacer and the diamond window element, whereby a vacuum encapsulated chamber is formed within the capsule.

In an exemplary embodiment, the present method of the present invention further includes the steps of coating interface surfaces of the cathode element, the annular insulating spacer and the diamond window element with a metallic wetting material. During cold-welding, the metallic wetting material contacts the first and second cold-weld rings to promote atomic adhesion therebetween. Preferably, the metallic wetting material is coated on the interface surfaces by a vacuum sputtering process, although other techniques can be used.

The process of providing the cathode element preferably includes forming a copper base, vacuum sputtering a nickel wetting material on an outer peripheral rim of the copper base to form a nickel-coated copper base, cleaning the nickel coated copper base through abrasion and etching the cleaned nickel coated copper base.

The process of providing the diamond window element preferably includes forming a diamond base, metalizing one face of the diamond base, vacuum sputtering a nickel wetting material on an outer peripheral rim of the diamond base to form a nickel coated diamond base, cleaning the nickel coated diamond base through abrasion and etching the nickel coated diamond base.

The present method further preferably includes coiling a first length of indium wire around a pin, joining opposite ends of the length of indium wire to form a contiguous ring, etching and drying the contiguous ring to form the first cold-ring and repeating the coiling, joining, etching and drying steps with a second length of indium wire to form the second cold-weld ring.

To precisely align the components of the cathode capsule, the present method further preferably includes stacking the cathode element, the insulating spacer, the diamond window element and the first and second cold-weld rings in an alignment fixture prior to cold-welding. The alignment fixture is then secured to an anvil of a vacuum press, wherein the step of cold-welding is performed in the vacuum press.

The present method further involves reducing contamination of a diamond amplified cathode capsule caused by outgassing during use of the capsule. The method generally includes the steps of installing a hermetically sealed, vacuum encapsulated, diamond amplified cathode capsule within an electron gun chamber, heating the capsule to a temperature sufficient to clean a diamond element of the capsule, deforming the capsule during the heating step to break the hermetical seal of the capsule, whereby an interior of the capsule is brought into fluid communication with the electron gun chamber, and pumping the electron gun chamber to evacuate out-gases from both the chamber and the interior of the capsule.

In a preferred embodiment, the capsule is formed by a cold-weld process, as described above, and comprises at least one cold-weld ring forming the hermetical seal of the capsule. The cold-weld ring softens during the heating and deforming step, thereby breaking the hermetical seal. In particular, the deforming step preferably includes the step of forming a fissure in the at least one cold-weld ring, wherein the fissure provides a fluid passage way between the interior of the capsule and the electron gun chamber. This deforming step further preferably includes the step of pulling the capsule in opposite directions by a moveable arm arrangement disposed within the electron gun chamber.

The preferred embodiments of the vacuum encapsulated hermetically sealed diamond amplified cathode capsule and the method for making same, according to the present invention, as well as other objects, features and advantages of this invention, will be apparent from the following detailed description, which is to be read in conjunction with the accompanying drawings. The scope of the invention will be pointed out in the claims.

DETAILED DESCRIPTION

Figure 1:
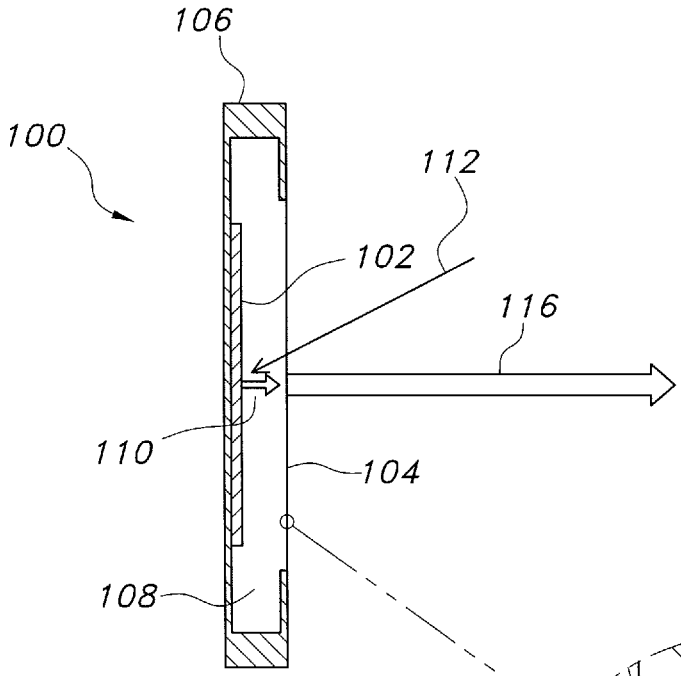
FIG. 1 (PRIOR ART)
FIG. 1 is a schematic side view of a cathode insert according to the prior art.
Figure 1A:
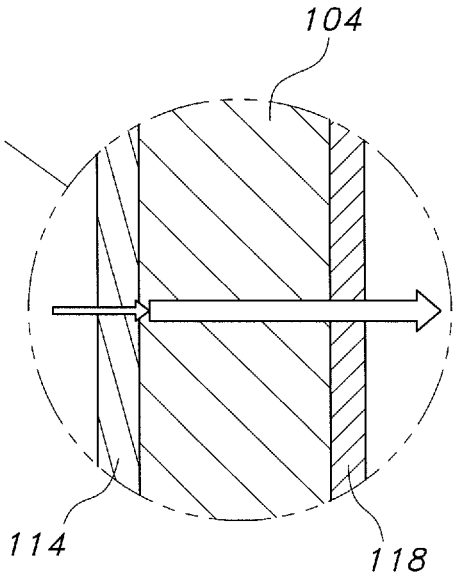
FIG. 1A (PRIOR ART)
FIG. 1*a* is an enlarged side view of the diamond window shown in FIG. 1.

FIGS. 1 and 1*a* show the general schematic structure of a prior art diamond amplified cathode insert 100, as described in U.S. Pat. Nos. 7,227,297 and 7,601,042 to Srinivasan-Rao et al. The cathode insert 100 generally includes a cathode element 102 and a diamond window 104 provided under vacuum in a housing 106. The housing defines a drift region 108, across which the primary electrons are accelerated to a desired energy to the input surface of the window 104 by an electric field. The cathode 102 shown in FIGS. 1 and 1*a* is in the form of a photocathode, which generates primary electrons 110 in response to an incident laser beam 112. However, as discussed in the Srinivasan-Rao patents, the invention described therein is also well suited to field emission and thermionic emission type cathodes.

The diamond window 104, also termed the secondary emitter, includes a non-contaminating negative-electron-affinity material and emits secondary electrons 116 in response to the incident primary electrons 110. Primary electrons 110 are received at an input surface 114 of the secondary emitter 104 and secondary electrons 116 are emitted from an emitting surface 118.

The input surface 114 of the diamond emitter 104 is a substantially uniform electrically conductive layer, which serves as an electric conductor to bring a replenishing current to the emitter. The emitting surface 118 has an enhanced negative-electron-affinity (NEA) material, which forms an outer layer of the window. The diamond dangling bonds are terminated by hydrogen to provide the enhanced NEA surface of the diamond. Secondary electrons are generated by the diamond in response to the primary electrons, and are emitted from the device through the NEA surface.

Thus, the '297 and '042 patents to Srinivasan-Rao et al. disclose a conceptual design for a diamond enhanced cathode insert, but an optimum structure for such a device and a method of manufacturing such a device has heretofore been unknown.

Figure 2:
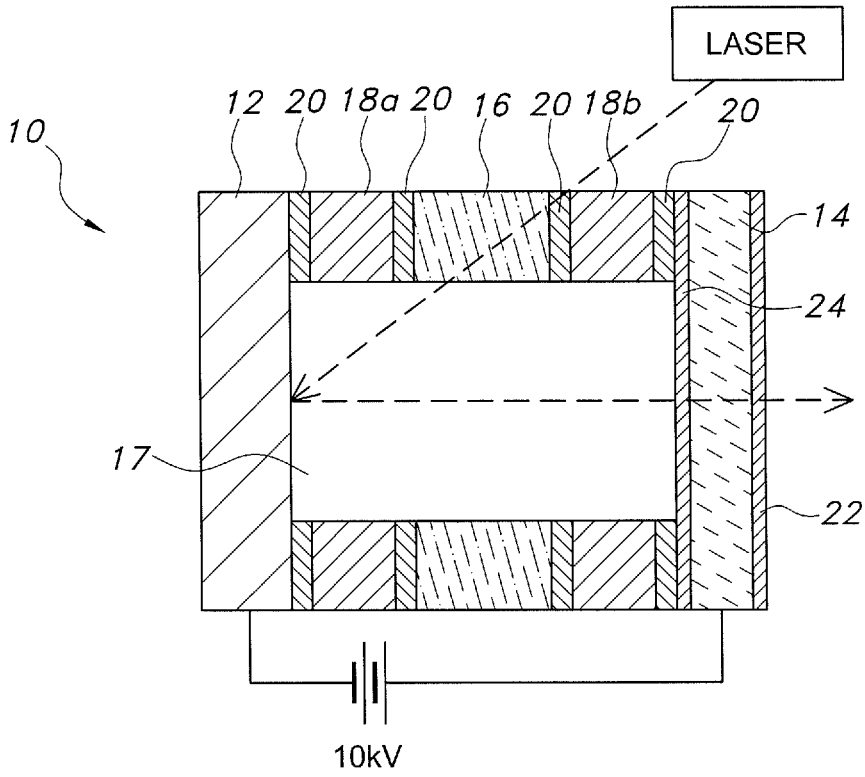
FIG. 2 is a cross-sectional view of the vacuum encapsulated, hermetically sealed, diamond amplified cathode capsule formed in accordance with the present method.
Figure 3:
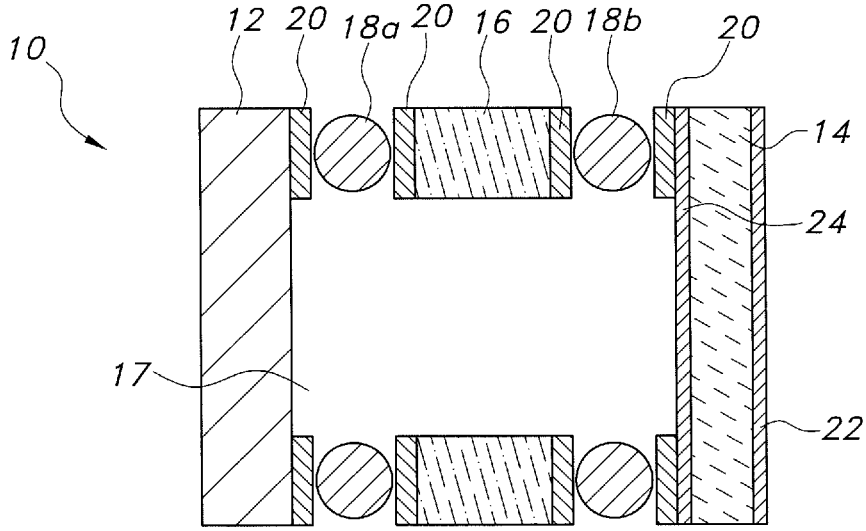
FIG. 3 is an exploded cross-sectional view of the present cathode capsule shown in FIG. 2 prior to assembly.

Turning now to FIGS. 2 and 3, a present vacuum encapsulated, hermetically sealed diamond amplified cathode capsule 10 is shown. The capsule 10 generally includes a cathode element 12 and a diamond window element 14 separated by an insulating spacer 16. As will be discussed in further detail below, the cathode element 12, the insulating spacer 16 and the diamond window element 14 are hermetically sealed together to form the capsule 10 having a vacuum encapsulated chamber 17 defined therein.

As will also be discussed in further detail below, the cathode element 12, the insulating spacer 16 and the diamond window element 14 are fixed together utilizing a cold-welding process. Accordingly, a first cold-weld ring 18*a* is provided between the cathode element 12 and the insulating spacer 16 and a second cold-weld ring 18*b* is provided between the insulating spacer 16 and the diamond window element 14. To promote atomic adherence, the surfaces of the cathode element 12, the insulating spacer 16 and the diamond window element 14 that are in contact with the cold-weld ring are coated with a metallic wetting material 20.

The cathode element 12 is in the form of a rectangular or circular disk and can be made from any cathode material known in the art. Cathode materials that can be used in the cathode insert include metals, such as copper, magnesium and lead. When forming a photocathode, high quantum efficiency photo-emissive materials, which include cesium potassium antimonide ($CsK_2Sb$), metals, multialkali, alkali telluride, alkali antimonide, multialkali antimonide, and cesiated semiconductor can be used. In a preferred embodiment, the cathode material used is a photo-sensitive oxygen-free copper (OFC).

The diamond window element 14 is made from diamond materials as described above with respect to the prior art. Preferably, the diamond window element 14 is made from a single crystal diamond hydrogenated to produce a negative-electron-affinity material 22 serving as the electron emitting surface. The diamond window element 14 further includes a uniform electrically conductive layer 24, which serves both as an electron input surface, as well as an electric conductor to bring a replenishing current to the emitter.

The insulating spacer 16 has an annular or ring-like form and is preferably made from an alumina, ceramic or any other insulating material known in the art.

It has been found that one of the preferred materials for the cold-weld rings 18*a*, 18*b* is indium due to its superior atomic adhesion properties. However, uses of other cold-weld materials, such as lead and tin, are also conceivable.

When indium cold-weld rings are used, the preferred wetting material 20 is nickel. It has been found that indium cold-welds better with nickel and each of the weld surfaces can be coated with nickel without affecting the functionality of the capsule. However, other wetting materials, which will ensure strong adhesion with the cold-weld ring can be used.

In the embodiments shown in FIGS. 2 and 3, the cathode element 12, the diamond window element 14 and the insulating spacer 16 are shown with the wetting material 20 applied on the outer peripheral rims or edges thereof. The wetting material 20 can be applied in this embodiment by masking the center of the cathode element 12, the diamond window element 14 and the insulating spacer 16 and vacuum sputtering the nickel wetting material on the outer rims of these components. If using an alumina material spacer 16, a MoMn/nickel coating is preferred on the spacer.

Figure 4:
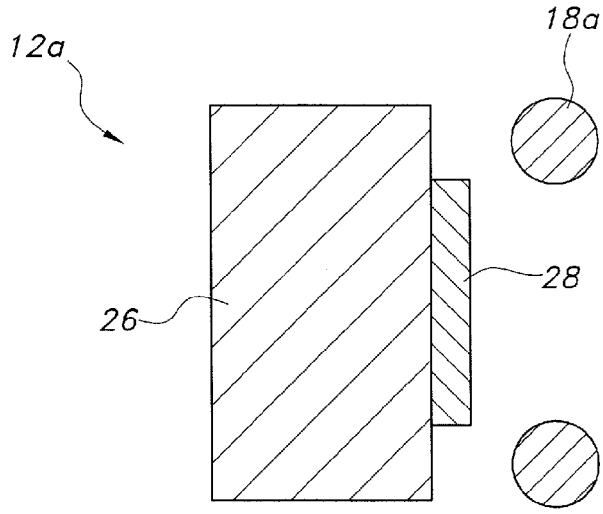
FIG. 4 is a cross-sectional view of an alternative embodiment of the cathode material layer of the present cathode capsule.

In an alternative embodiment, as shown in FIG. 4, a photocathode element 12*a* can be made from a nickel base 26 with a photo-sensitive OFC material layer 28 provided in the center of a major surface thereof. This leaves a surface along the outer rim of the photocathode element 12*a* made of nickel for adhesion with the indium cold-weld ring 18*a*.

Having described the individual components of the present vacuum encapsulated, hermetically sealed diamond amplified cathode capsule 10, a method for fabricating this device will now be described. In general, the capsule 10 is made using a cold-weld process in a manner that will vacuum encapsulate the components to protect the sensitive cathode material. The present method for assembling these components is under vacuum to form a hermetically sealed capsule.

The constraints on the process and the capsule are: 1) The process should be able to accommodate laser cleaning of the cathode 12 and vacuum baking of the diamond 14 prior to assembly; 2) The ultimate capsule 10 should be able to handle a temperature range of +350° C. (bake out temperature of diamond) to −200° C. (operating temperature in SRF injector) without losing the internal vacuum; and 3) The process should also be compatible with the fabrication of sensitive cathodes such as $K_2CsSb$. The process described below meets most of these constraints.

The cathode element 12 is first prepared by machining the surfaces of a copper material, for example, with a single point carbide tool to a 32*c* micro finish. The surface preparation prior to cold-welding includes light etching in a 3.7%:96.3% HCl:water solution for 3 minutes. This is followed by a rinse in distilled water and drying with high purity compressed nitrogen gas. Upon drying the samples, they are cleaned further in a glass beaker containing acetone followed by nitrogen blow drying. The dry samples are placed onto a clean glass slide, with sensitive side facing down, to prevent contamination from other metals or organic material.

When preparing a nickel based photocathode element 12*a*, the nickel surfaces are first sanded using microcut paper sheets having a soft 600 grit. Preferably, each side of the nickel is circularly sanded until any deep scratches are removed from the surfaces. Each flat side of each nickel piece is preferably rotated in place to form concentric rings using the microcut paper sheets. The nickel pieces are then placed in a beaker of acetone until ready to etch.

Figure 5:
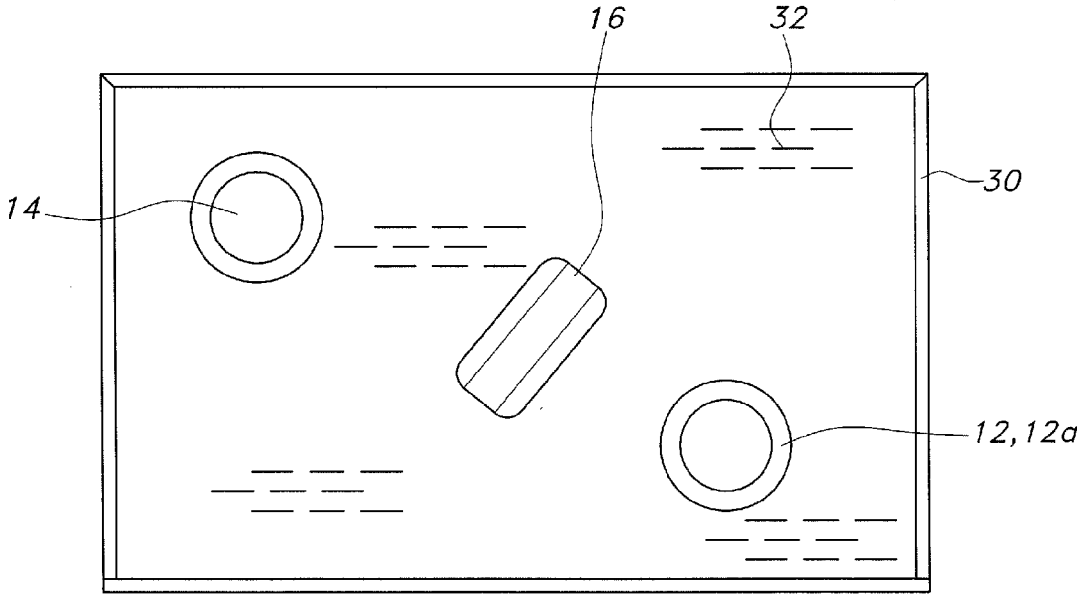
FIG. 5 illustrates etching of the cathode capsule components according to the present method.
Figure 6A:
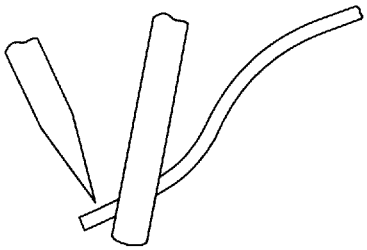
FIGS. 6*a*-6*d* illustrate the steps of forming the cold weld rings according to the present method.
Figure 6B:
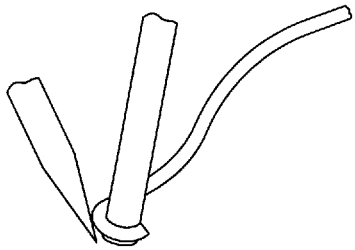
Figure 6C:
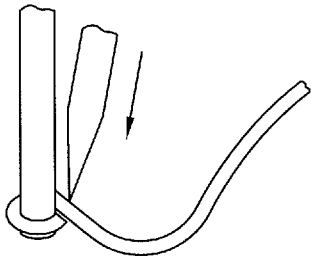
Figure 6D:
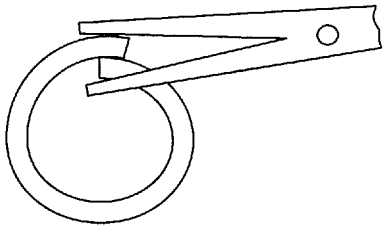

As shown in FIG. 5, etching of the cathode element 12 or photocathode element 12*a* is done in an etching receptacle 30 containing 9:1 water:$HNO_3$ etching solution 32 with the joining surface of the cathode element 12, 12*a* facing upwards, but fully immersed in the solution. The cathode element 12, 12*a* is preferably etched for 3 minutes. After this initial etching step, the cathode element 12, 12*a* is preferably immediately placed in 4:1 water:HCl solution and etched for an additional 10 minutes in the same orientation. After etching, the cathode element 12, 12*a* is preferably immediately placed in an acetone bath after etching.

The diamond window element 14 is prepared by metalizing one face of the diamond. For example, one face of the diamond can be metalized with 15 Å of Ti and 25 Å of Pt. The diamond window element 14 is then cleaned with acetone and the wetting material layer 20 is applied with a vacuum sputter process with 70 nm of 99.99% nickel. As shown in FIG. 5, the diamond window element 14 is then placed, with its joining surface facing upwards, in an etching receptacle 30 containing 9:1 water:$HNO_3$ etching solution for 1.5 minutes. The diamond window element 14 is then transferred to 4:1 water:HCl etching solution and etched for an additional 5 minutes. In each step, the hydrogenated surface of the diamond should be kept above the solution to prevent contaminating the solution. The diamond window element 14 should then immediately be placed in a beaker of acetone after etching.

The insulating spacer 16 is prepared by first coating the two axial faces of the spacer with 10 Å layers of Ni, Cu or Cr/Cu. Using 600 soft grit microcut paper sheets, each side of the alumina spacer 16 is circularly sanded until the surfaces appear bright. Preferably, each flat side is rotated during sanding to form concentric rings. After sanding, the alumina spacer 16 is placed in a beaker of acetone until ready to etch.

As shown in FIG. 5, the alumina spacer 16 is placed in an etching receptacle 30 containing 9:1 water:$HNO_3$ etching solution. The spacer 16 is preferably suspended in the receptacle 30 such that only the metalized surface is immersed in the etching solution. The spacer 16 is etched for 1.5 minutes. Following this initial etching, the spacer 16 is placed, in the same orientation, in 4:1 water:HCl solution for 5 minutes for a second etching. Following this second etching, the spacer 16 is immediately placed in an acetone bath.

The cold-welding rings 18*a* and 18*b* are preferably 0.5-1.0 mm diameter 99.999% pure indium wire formed into a ring having an inner diameter of 3.8 mm. It is preferable to make a contiguous ring to ensure complete hermetic sealing. Specifically, as shown in FIGS. 6*a*, 6*b*, 6*c* and 6*d*, *a* segment of 0.5-1.0 mm diameter 99.999% pure indium wire is first cleaned with acetone. The segment is then coiled around a 0.150 inch pin. The ends of the segment are then cut on a diagonal with a clean razor blade and joined or pinched together with tweezers. The clean indium ends are preferably merged to form a contiguous ring.

The indium rings 18*a*, 18*b* are prepared in a manner similar to that of the copper cathode element 12. In particular, the rings 18*a*, 18*b* are placed in separate 9:1 water:HCl etching solution for 4 minutes and immediately placed in an acetone bath after etching. The indium rings 18*a*, 18*b* then undergo nitrogen drying, cleaning in acetone, and final nitrogen drying. The indium rings 18*a*, 18*b* are then placed on a clean glass slide to prevent further contamination.

Figure 7:
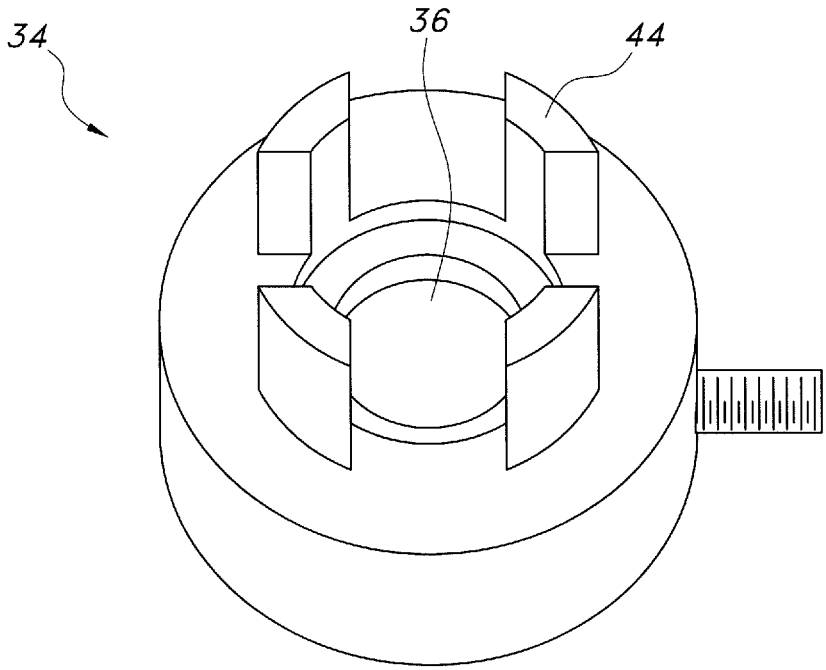
FIG. 7 is a perspective view of the alignment fixture used in forming the cathode capsule according to the present method.
Figure 8:
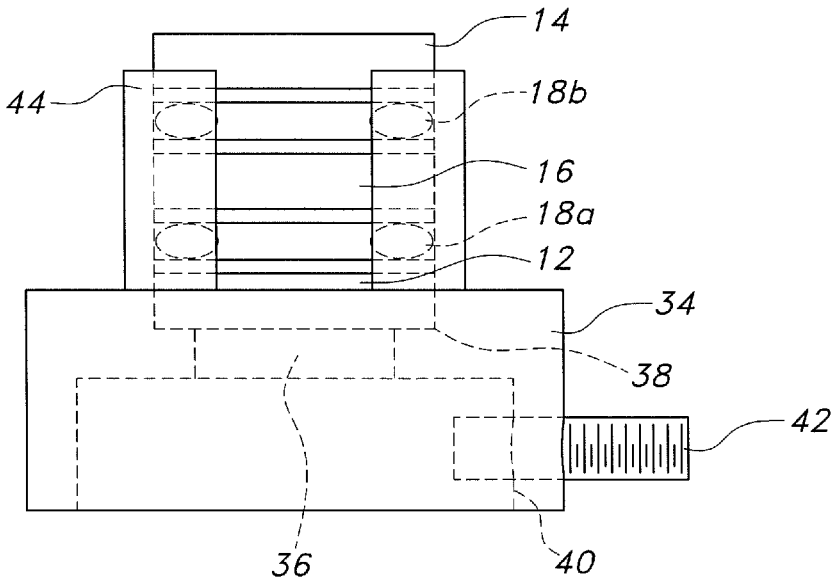
FIG. 8 is a side view of the alignment fixture shown in FIG. 7, with the cathode capsule sub-components loaded therein.

Once the nickel-coated cathode element 12, diamond window element 14 and insulating spacer 16 and the indium rings 18*a*, 18*b* are prepared, all of these components are stacked in a specially designed alignment fixture 34, as shown in FIGS. 7 and 8. It has been found that stacking the components so that all the nickel pieces and indium rings line up is critical for hermetically sealing the capsule 10. Hence, a specially designed alignment fixture 34 is provided to facilitate precise positioning of the components with respect to each other prior to cold-welding.

The fixture 34 has an annular form defining a central aperture 36. The aperture 36 has widened portions on its opposite ends to form an upper component receiving ledge 38 and a lower press anvil bore 40 opposite the ledge. A 2-56×¼ set screw 42 extends transversely from outside the fixture into the anvil bore 40.

Extending upwardly from a top surface of the fixture 34 are four component alignment fingers 44. The fingers 44 are equally spaced in a radial arrangement around the central aperture 36. The fingers 44 have an inner surface, which together match the periphery of the capsule components. Alternatively, a guide sleeve may be attached to the fixture 34 for centering purposes. In any event, the components are placed within the fingers 44 such that the inner surfaces of the fingers come into contact with the outer peripheral surfaces of the capsule components to axially align the components with respect to each other.

Once the components 12, 14, 16, 18*a*, 18*b* have been stacked into the fixture 34, the fixture is placed within a vacuum press 46 fabricated from ultra-high vacuum (UHV) components. Vacuum presses are known in the art and will not be discussed in too much detail here. Generally, a vacuum press includes an accessible vacuum chamber, which can be evacuated of air, and in which the movable press elements, including a press anvil and a press ram, are accommodated.

The press used for the present method utilizes a 12.7×2 mm thread that transfers rotary motion into linear motion, moving a precision hardened steel ram 48 supported by a vacuum compatible linear ball bearing. Below the ram is a static anvil 50 of identical dimensions, in which parallelism between the two working surfaces is maintained within 25 microns. Rotary force is applied to the ram drive screw using a calibrated torque wrench.

Figure 9:
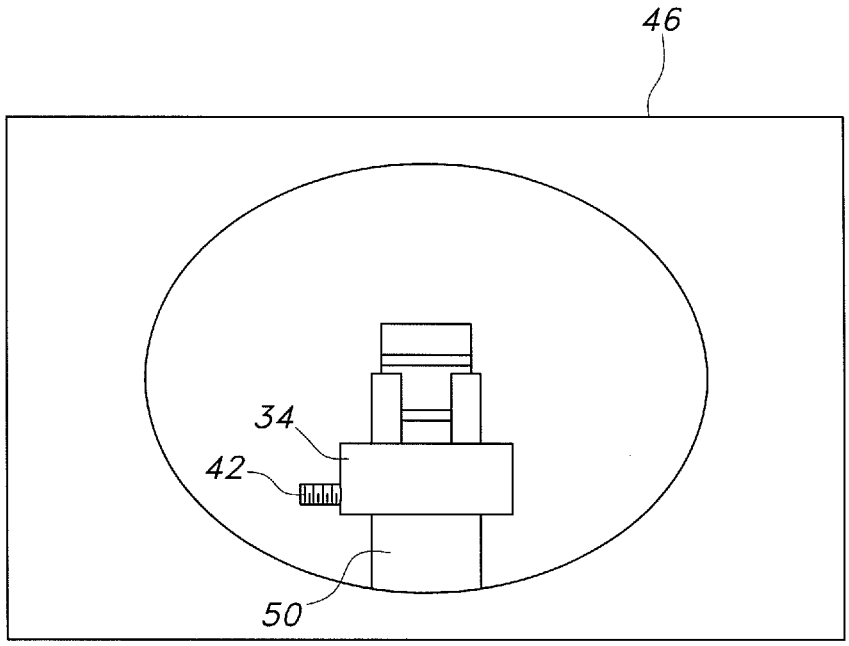
FIG. 9 is a side view of the alignment fixture shown in FIG. 7 having the cathode capsule sub-components loaded therein and placed in a vacuum press according to the present method.
Figure 10:
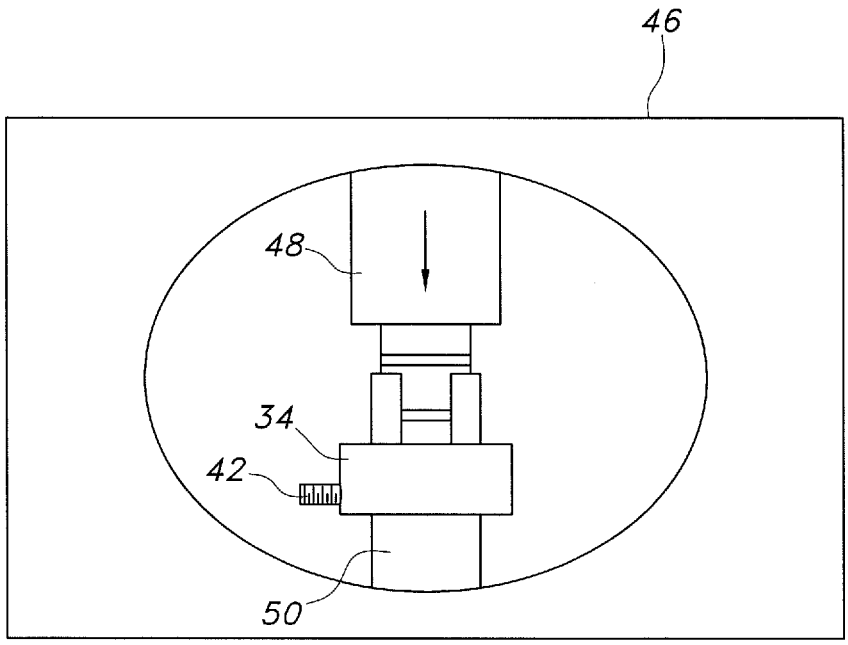
FIG. 10 is a side view showing compression of the cathode capsule sub-components by the vacuum press according to the present method.

FIGS. 9 and 10 show the capsule components placed into the fixture 34, which in turn is placed on the press anvil 50. The anvil 50 of the press is received within the anvil bore 40 of the fixture 34 and the set screw 42 is tightened against the anvil to secure the fixture within the press 46 to maintain concentricity while applying pressure. The vacuum chamber is evacuated such that the components will be assembled in the press under vacuum in the range of $1.0\times10^{-6}$ torr or less. Approximately 3.5 Nm of applied torque provides sufficient pressure over the 19.5 $mm^2$ area of the capsule to form an indium cold-weld joint.

After pressing, the fixture 34 is removed from the anvil 50 by loosening the set screw 42. To remove the assembled capsule 10, a drill bit with a clean wipe can be inserted in the opposite end of the fixture aperture and the capsule can be tapped out with a hammer while holding the fixture in a vice. Care should be taken to avoid any excess indium on the ceramic surfaces. The capsule 10 is then preferably leak checked and tested with respect to voltage hold-off properties.

The leak check procedure utilizes a modified conflate flange (CF blank) holder, and o-ring setup. A scroll pump with SenTorr gauge controller is used to make sure the capsule will be pumped down to at least 18-20 mtorr. A turbo pump with gauge is then used to pump down and record pressure. Acceptable vacuum levels easily reach 10-7 torr within 2 hours.

The voltage hold-off test procedure involves use of a test set-up designed to arc or trip the power source when the maximum voltage hold-off has been reached. The test procedure involves slowly applying increasing voltage up to 15 kV. Acceptable capsules are able to hold-off at least 5 kV.

The entire assembly is performed at room temperature, making it a UHV process, compatible with $K_2CsSb$. In the case of metal cathodes, the laser cleaning of the cathode can be performed prior to welding the cathode to the diamond/ceramic unit. The vacuum system can be modified to accommodate these requirements.

Thus, a process for fabricating hermetically sealed diamond amplified cathode capsules is provided. It is a room temperature process that is compatible with UHV vacuum and photo-sensitive cathodes such as $K_2CsSb$. Compatibility with diamond bake out and cryogenic operation is also achieved.

The capsule 10 is designed such that, with minimal modification, the assembly can be inserted into any of the RF injectors that are currently operational. This capsule can be used to increase the electron beam current in many existing electron beam facilities. It can also be incorporated in numerous Free Electron Laser, Energy-Recovery LINAC facilities that are being considered for construction.

The present capsule 10 is particularly well suited for use in low-current injector applications, where contamination of the cathode due to out-gassing of the diamond element is relatively minor. However, as is well known in the art, in high-current injector applications, steps need to be taken to minimize contamination of the cathode element due to out-gassing. Conventionally, these steps include treating the input surface of the diamond element to reduce out-gassing, using a cathode material that is less susceptible to out-gassing contamination and pumping the injector chamber during operation to evacuate the contaminating gases produced by the diamond element.

Of these steps, pumping the injector chamber during operation to evacuate the contaminating gases has proven to be a very efficient method to reduce contamination of the cathode element. However, use of a vacuum encapsulated diamond amplified cathode capsule, as proposed by the present device, would seem to prevent evacuation of outgases within the capsule when using this technique. In other words, while pumping the injector chamber during operation, contaminating gases will be evacuated from within the injector chamber, and any outgases within the sealed capsule will remain trapped within the capsule and result in contamination of the cathode within the capsule.

Figure 11:
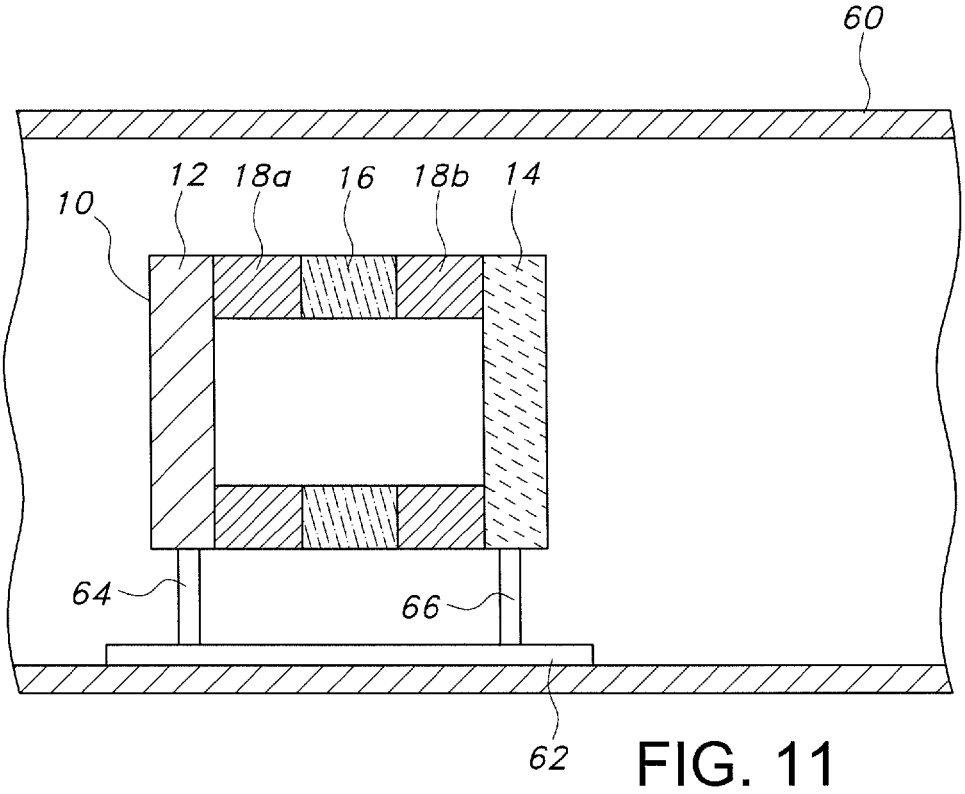
FIG. 11 is a diagrammatic cross-sectional view of the present vacuum encapsulated, hermetically sealed, diamond amplified cathode capsule installed in an electron gun.
Figure 12:
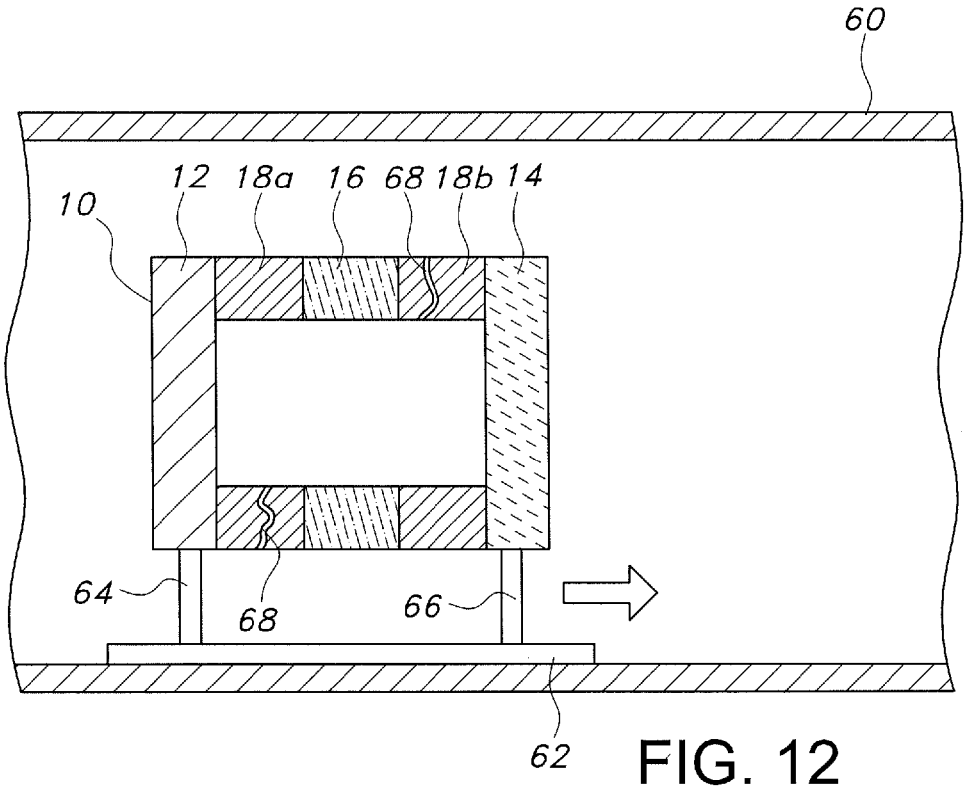
FIG. 12 is a diagrammatic cross-sectional view of the capsule shown in FIG. 11 being opened prior to use, according to the present method.

The present capsule 10 solves this problem by allowing for an easy opening of the capsule during use to permit outgases within the capsule to escape out of the capsule when pumping the injector chamber. Specifically, as shown in FIG. 11, the capsule 10 of the present device is preferably supported within a conventional electron gun or injector 60 by a movable arm arrangement 62. The arm arrangement 62 includes a cathode retaining arm 64, for holding the cathode element 12, and a diamond retaining arm 66, for holding the diamond element 14 of the capsule 10. At least one of the arms 64, 66 is movable with respect to the other arm so that the distance between the arms can be varied.

In use, the capsule 10 is installed in the injector 60 with the cathode element 12 and the diamond element 14 of the capsule securely mounted in their respective retaining arms 64, 66 of the movable arm arrangement 62. The capsule 10 is then heated to a temperature sufficient to clean the diamond element, which is typically about 300-400° C. Such pre-heating and cleaning of the diamond is generally required with such devices prior to use, regardless of whether the capsule 10 of the present device is used.

However, the unique structure of the capsule 10 of the present capsule takes advantage of this pre-heating step by allowing the capsule to open while heating. In particular, while the capsule is being heated, the arm arrangement 62 is activated to slightly increase the distance between the cathode retaining arm 64 and the diamond retaining arm 66. As a result, the capsule 10 is stretched to a point whereupon the relatively soft indium cold-weld rings 18*a*, 18*b* begin to separate from their respective cathode, insulator or diamond surface interfaces, thereby leaving a gap or fissure 68 for vacuum pumping of the space between the cathode and diamond. These gaps or fissures 68 may also be formed within the soft indium cold-weld rings 18*a*, 18*b*. In either case, the fissures 68 provide passageways through which gases trapped within the capsule may escape.

Formation of these fissures 68 within the indium rings 18*a*, 18*b* is facilitated by the heating and stretching of the rings, which cause the rings to soften yet retain their structural integrity for holding the capsule together. Typically, the indium rings 18*a* and 18*b* will begin to soften and begin to form fissures 68 under tension at about 150° C. The arm arrangement 62 can be provided with a heating mechanism to provide the heat necessary to soften the indium rings 18*a*, 18*b*, as well as the heat necessary to clean the diamond element.

Once the fissures 68 are formed, any out-gases contained within the capsule 10 can then be evacuated by pumping the overall injector chamber 60. As a result, contamination of the cathode element 12 by out-gases produced by the diamond element 14 can be minimized.

As mentioned above, in low-current applications, where problems with out-gas sing are minimal, the capsule 10 need not be opened during use. In these applications, the capsule will remain hermetically sealed both prior to and during use. It can be appreciated that, even in applications where the capsule is opened during use, the hermetical seal produced as a result of the present method serves a beneficial purpose in maintaining a contamination free environment for the cathode element during storage and transport of the capsule prior to use.

Although preferred embodiments of the present invention have been described herein with reference to the accompanying drawings, it is to be understood that the invention is not limited to those precise embodiments and that various other changes and modifications may be affected herein by one skilled in the art without departing from the scope or spirit of the invention, and that it is intended to claim all such changes and modifications that fall within the scope of the invention.

What is claimed is:

1. A diamond amplified cathode capsule for generating an electron beam of secondary electrons, the capsule comprising:

a cathode element having a primary emission surface adapted to emit primary electrons;

an annular insulating spacer;

a diamond window element comprising a diamond material and having a secondary emission surface adapted to emit secondary electrons in response to primary electrons impinging on the diamond window element;

a first cold-weld ring disposed between said cathode element and said annular insulating spacer; and a second cold-weld ring disposed between said annular insulating spacer and said diamond window element, wherein said cathode capsule is formed by a vacuum cold-weld process such that said first cold-weld ring forms a hermetical seal between said cathode element and said annular insulating spacer and said second cold-weld ring forms a hermetical seal between said annular spacer and said diamond window element whereby a vacuum encapsulated chamber is formed within said capsule.

2. A diamond amplified cathode capsule as defined in claim 1, wherein said cathode element comprises a photo-sensitive material such that said cathode element forms a photocathode element.

3. A diamond amplified cathode capsule as defined in claim 1, wherein said first and second cold-weld rings comprise a material selected from the group consisting of indium, lead and tin.

4. A diamond amplified cathode capsule as defined in claim 1, wherein said cathode element, said diamond window element and said annular insulating spacer comprise interface surfaces coated with a metallic wetting material, said metallic wetting material being in contact with one of said first and second cold-weld rings to promote atomic adhesion therebetween.

5. A diamond amplified cathode capsule as defined in claim 4, wherein said first and second cold-weld rings comprise an indium material and said metallic wetting material comprises nickel.

6. A diamond amplified cathode capsule as defined in claim 4, wherein said cathode element comprises a copper base and said metallic wetting material comprises a nickel material vacuum sputtered on an outer peripheral rim of said copper base.

7. A diamond amplified cathode capsule as defined in claim 4, wherein said cathode element comprises a nickel base having a major surface with a center, and a photo-sensitive oxygen-free copper material layer disposed in said center, said photo-sensitive oxygen-free copper material layer forming said primary emission surface.

8. A method for fabricating a diamond amplified cathode capsule for generating an electron beam of secondary electrons, the method comprising:

providing a cathode element having a primary emission surface adapted to emit primary electrons;

providing an annular insulating spacer;

providing a diamond window element comprising a diamond material and having a secondary emission surface adapted to emit secondary electrons in response to primary electrons impinging on the diamond window element;

stacking a first cold-weld ring between the cathode element and the annular insulating spacer;

stacking a second cold-weld ring between the annular insulating spacer and the diamond window element; and cold-welding the cathode element, the annular insulating spacer, the diamond window element and the first and second cold-weld rings under vacuum such that the first cold-weld ring forms a hermetical seal between the cathode element and the annular insulating spacer and the second cold-weld ring forms a hermetical seal between the annular spacer and the diamond window element, whereby a vacuum encapsulated chamber is formed within the capsule.

9. A method as defined in claim 8, further comprising coating interface surfaces of the cathode element, the annular insulating spacer and the diamond window element with a metallic wetting material, the metallic wetting material being in contact with the first and second cold-weld rings to promote atomic adhesion therebetween.

10. A method as defined in claim 9, wherein the metallic wetting material is coated on the interface surfaces by a vacuum sputtering process.

11. A method as defined in claim 8, wherein providing the cathode element comprises:

forming a copper base;

vacuum sputtering a nickel wetting material on an outer peripheral rim of the copper base to form a nickel coated copper base;

cleaning the nickel coated copper base by abrasion; and etching the cleaned nickel coated copper base.

12. A method as defined in claim 8, wherein providing the diamond window element comprises:

forming a diamond base having a face;

metalizing the face of the diamond base;

vacuum sputtering a nickel wetting material on an outer peripheral rim of the diamond base to form a nickel coated diamond base;

cleaning the nickel coated diamond base by abrasion; and etching the nickel coated diamond base.

13. A method as defined in claim 8, further comprising:

coiling a first length of indium wire having opposite ends around a pin;

joining the opposite ends of the first length of indium wire to form a contiguous ring;

etching and drying the contiguous ring to form the first cold-weld ring; and repeating the coiling, joining, etching and drying with a second length of indium wire to form the second cold-weld ring.

14. A method as defined in claim 8, wherein the cathode element, the insulating spacer, the diamond window element and the first and second cold-weld rings are stacked in an alignment fixture prior to cold-welding.

15. A method as defined in claim 14, further comprising securing the alignment fixture to an anvil of a vacuum press, wherein the cold-welding is performed in the vacuum press.

16. A method as defined in claim 8, wherein the cold-welding is performed in a vacuum press.

17. A method as defined in claim 8, wherein the cathode element comprises a photo-sensitive material such that the cathode element forms a photocathode element.

18. A method for reducing contamination of a diamond amplified cathode capsule caused by out-gassing during use of the capsule, the method comprising:

installing a hermetically sealed, vacuum encapsulated, diamond amplified cathode capsule within an electron gun chamber;

heating the capsule to a temperature sufficient to clean a diamond element of the capsule;

deforming the capsule during the heating to break the hermetical seal of the capsule, whereby an interior of the capsule is brought into fluid communication with the electron gun chamber; and pumping the electron gun chamber to evacuate out-gases from both the chamber and the interior of the capsule.

19. A method as defined in claim 18, wherein the capsule is formed by a cold-weld process and comprises at least one cold-weld ring forming the hermetical seal of the capsule, and wherein the at least one cold-weld ring softens during heating and deforming, thereby breaking the hermetical seal.

20. A method as defined in claim 19, wherein deforming comprises forming a fissure in the at least one cold-weld ring, the fissure providing a fluid passage way between the interior of the capsule and the electron gun chamber.

21. A method as defined in claim 19, wherein the cold-weld ring comprises indium, and wherein the capsule is heated to a temperature of about 300-400° C., the indium cold-weld ring softening at about 150° C.

22. A method as defined in claim 18, wherein the capsule is pulled in opposite directions during deforming by a moveable arm arrangement disposed within the electron gun chamber.

* * * * *